US005897262A

United States Patent [19]

Bratby-Carey

[11] Patent Number: 5,897,262

[45] Date of Patent: Apr. 27, 1999

[54] NAIL POLISH APPLICATION AND REMOVAL DEVICE

[76] Inventor: Mary Bratby-Carey, 8841 Helen James Ave., San Diego, Calif. 92126

[21] Appl. No.: 09/063,217

[22] Filed: Apr. 20, 1998

[51] Int. Cl.[6] ..... B43K 27/02

[52] U.S. Cl. ..... 401/18; 401/23

[58] Field of Search ..... 401/18, 23, 24, 401/19, 16, 25, 17

[56] References Cited

U.S. PATENT DOCUMENTS

| | | | |
|---|---|---|---|
| D. 316,034 | 4/1991 | Degaetano | D9/338 |
| 2,736,050 | 2/1956 | Lee | 401/18 |
| 3,690,777 | 9/1972 | Costa | 401/18 |
| 4,627,758 | 12/1986 | Winthrop | 401/208 |
| 4,640,637 | 2/1987 | Winthrop | 401/101 |
| 4,854,759 | 8/1989 | Morane et al. | 401/119 |
| 4,927,282 | 5/1990 | Morane | 401/129 |
| 4,932,802 | 6/1990 | Cantone | 401/17 |
| 5,655,554 | 8/1997 | Goldberg | 401/18 |
| 5,762,077 | 6/1998 | Griffiths, Jr. | 401/18 |

*Primary Examiner*—David J. Walczak
*Attorney, Agent, or Firm*—Goldstein & Canino

[57] ABSTRACT

A device for applying and removing nail polish comprising a first container for storing polish remover solvent and a second container for storing nail polish. Each container includes a threaded neck and an opening. A lid structure includes a first end for rotatably mounting to the threaded neck of the first container and a second end for rotatably mounting to the threaded neck of the second container. A sponge applicator snap fits into the opening of the first container for selectively permitting dispensing of the polish remover solvent. A brush assembly is mounted within the lid structure for facilitating application of the nail polish. The nail polish application and removal device also includes a check valve snap fitted into the opening of the second container for straightening the bristles of the brush assembly, and a replaceable emery board removably attached to the exterior surface of the first container for filing and shaping nails.

4 Claims, 3 Drawing Sheets

NAIL POLISH APPLICATION AND REMOVAL DEVICE

BACKGROUND OF THE INVENTION

This invention relates to a nail polish application and removal device. More particularly, the invention relates to a device comprising a nail polish remover, a sponge applicator, nail polish, a brush applicator, and an emery board, which are all stored within an easy-to-use and easy-to-carry unit.

In order to maintain professional nail appearance, a variety of nail care implements are required including nail polish, a bottle of nail polish remover, cotton balls, and emery boards. However, it is difficult to fit all the nail care implements inside a make-up case or a purse. In addition, the cap of a conventional bottle of nail polish remover may inadvertently open if it is improperly handled, causing the polish removing fluid inside the bottle to spill and ruin clothing and personal articles it comes in contact with. Because conventional nail care implements are so awkward and troublesome to carry, they are not typically carried by a woman who is traveling, despite the fact that a cosmetic treatment for the fingernails is frequently required in order to maintain a professional nail appearance. Thus, it is desirable to have a device that will allow a traveling woman to maintain a professional nail appearance without the necessity of having to carry bulky cotton balls, and heavy bottles of nail polish and nail polish remover.

Various references uncovered in the prior art provide nail care implements for applying and removing nail polish. For example, U.S. Pat. No. 4,932,802 to Cantone discloses a nail polish bottle cover designed for threading onto a threaded neck of a standard nail polish bottle which includes a nail polish remover dispenser incorporated therein. U.S. Pat. No. 4,627,758 to Winthrop discloses a nail polish removing apparatus which includes an elongated hollow housing having an opening, a reservoir for nail polish removing fluid disposed in the housing, and a continuous belt extending from the reservoir to the opening. In the field of nail polish applicators, many devices have been designed which employ an applicator brush for applying nail polish contained in a bottle. For example, U.S. Pat. No. 4,640,637 to Winthrop discloses an apparatus for dispensing and applying nail polish. Likewise, U.S. Pat. No. 4,854,759 to Morane discloses a device for applying nail polish that includes a cap, a sheath integrally joined to the cap, and an applicator brush carried by the sheath. U.S. Pat. No. 4,927,282 to Morane discloses another container for nail polish of elongated shape that makes it possible to use a relatively short brush.

Despite all these nail care implements, there is still a further need to provide an improved nail polish application and removal device. Such a nail polish application and removal device should be simple in construction so as to minimize manufacturing cost, and yet contains all the necessary devices for maintaining a professional nail appearance. Moreover, such a nail polish application and removal device can be connected in an assembled configuration so that it can fit easily inside of a make-up case of a purse.

While these units mentioned above may be suitable for the particular purpose employed, or for general use, they would not be as suitable for the purposes of the present invention as disclosed hereafter.

SUMMARY OF THE INVENTION

It is an object of the invention to provide a nail polish application and removal device which is simple in construction so as to minimize manufacturing cost, and yet contains all the necessary devices for maintaining professional nail appearance.

It is another object of the invention to provide a nail polish application and removal device, which can be connected in an assembled configuration for convenient storage, and carrying purposes.

It is yet another object of the invention to provide a nail polish application and removal device which eliminates the necessity of having to carry a bottle of nail polish remover, cotton balls, nail polish, and emery boards in order to maintain professional nail appearance.

It is a further object of the invention to provide a nail polish application and removal device which employs a sponge applicator assembly having a spring-loaded push valve for preventing accidental spillage of the polish removing solvent.

The invention is a device for applying and removing nail polish comprising a first container for storing polish remover solvent and a second container for storing nail polish. Each container includes a threaded neck and an opening. A lid structure includes a first end for rotatably mounting to the threaded neck of the first container and a second end for rotatably mounting to the threaded neck of the second container. A sponge applicator snap fits into the opening of the first container for selectively permitting dispensing of the polish remover solvent. A brush assembly is mounted within the lid structure for facilitating application of the nail polish. The nail polish application and removal device also includes a check valve snap fitted into the opening of the second container for straightening the bristles of the brush assembly, and a replaceable emery board removably attached to the exterior surface of the first container for filing and shaping nails.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
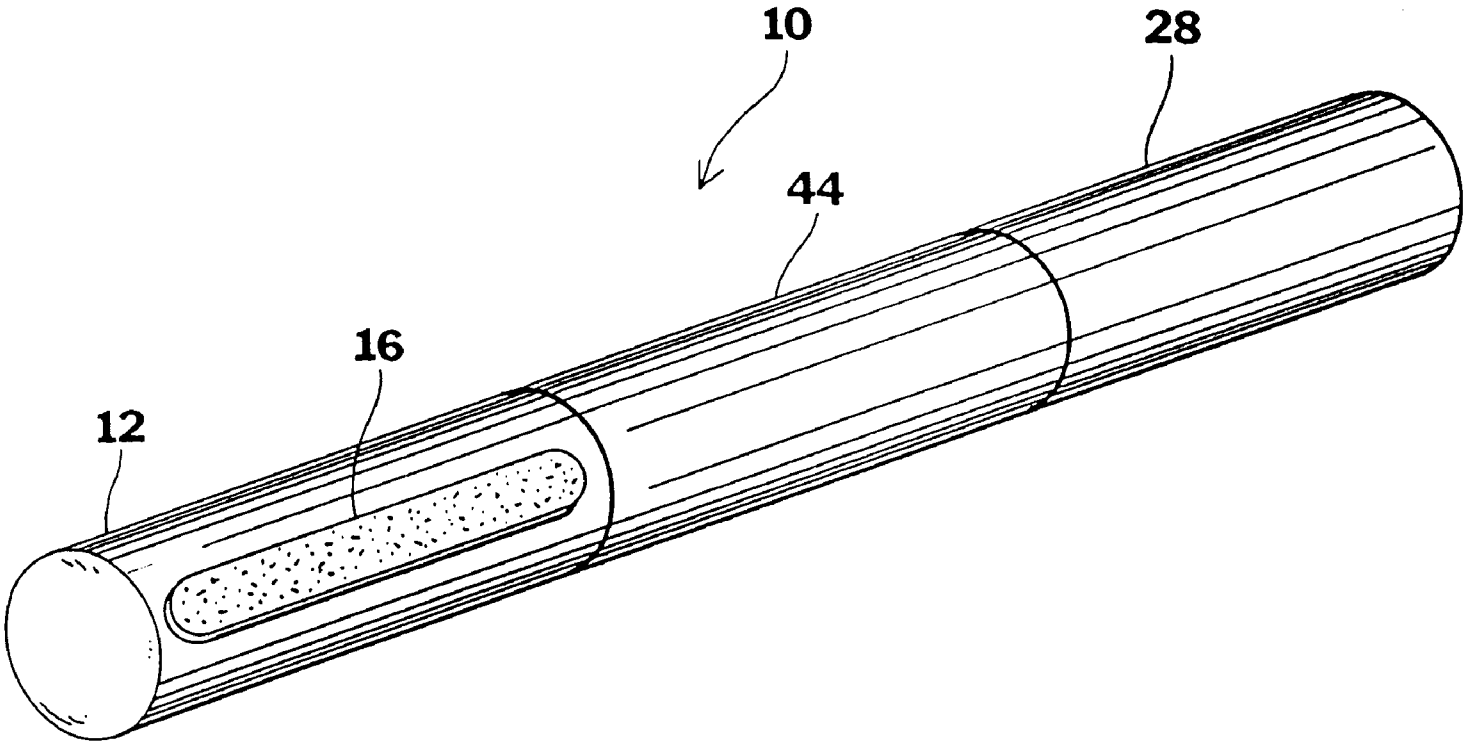
FIG. 1 is a diagrammatic perspective view of the instant invention in an assembled configuration for convenient storage and carrying purposes.
Figure 3:
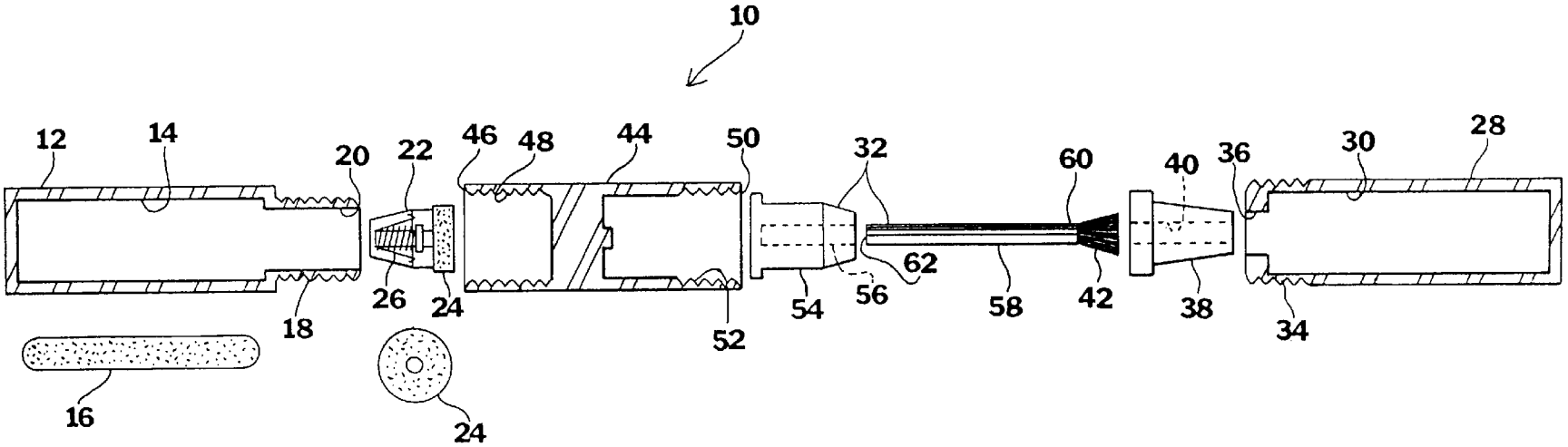
FIG. 3 is an exploded view of the instant invention with the first and second containers detached from the lid structure of the instant invention.

FIG. 1 illustrates a nail polish application and removal device 10 in an assembled configuration for convenient storage and carrying purposes. FIG. 3 illustrates the nail polish application and removal device 10 comprising a first container 12 having an internal reservoir 14 for storing nail polish removing solvent. The first container 12 can be constructed of a flexible and resilient plastic material or any other suitable material for storing and dispensing solvent for removing nail polish. Referring momentarily to FIG. 1, an emery board 16 is attached to the exterior surface of the first container 12 for filing and shaping nails. The emery board 16 is replaceable and can be removed from the first container 12 for replacement by another emery board. The emery board 16 is provided with a coating of adhesive for securing the emery board 16 to the exterior surface of the first container 12, and a peelable backing for preventing the adhesive from coming into contact with the surrounding environment prior to actual use.

FIG. 3 illustrates the first container 12 further including a threaded neck 18 and an opening 20 for receiving a sponge applicator assembly 22, out of which the nail polish remover solvent is selectively dispensed. The sponge applicator assembly 22 snap fits into the opening 20 of the first container 12 for facilitating application of the nail polish remover solvent, as viewed in drawing FIG. 2. The sponge applicator assembly 22 has an exterior portion, which coincides with the interior configuration of the opening 20 of the first container 12 such that the sponge applicator assembly 22 is firmly engaged therein. The sponge applicator assembly 22 includes a disc shaped sponge pad 24, and a spring-loaded push valve 26 attached to the sponge pad 24 for selectively dispensing the nail polish remover solvent from the internal reservoir 14 of the first container 12 onto the sponge pad 24. In addition to permitting selective dispensing of the nail polish remover solvent, the sponge applicator assembly 22 also serves to prevent inadvertent spilling of the nail polish remover solvent.

Figure 2:
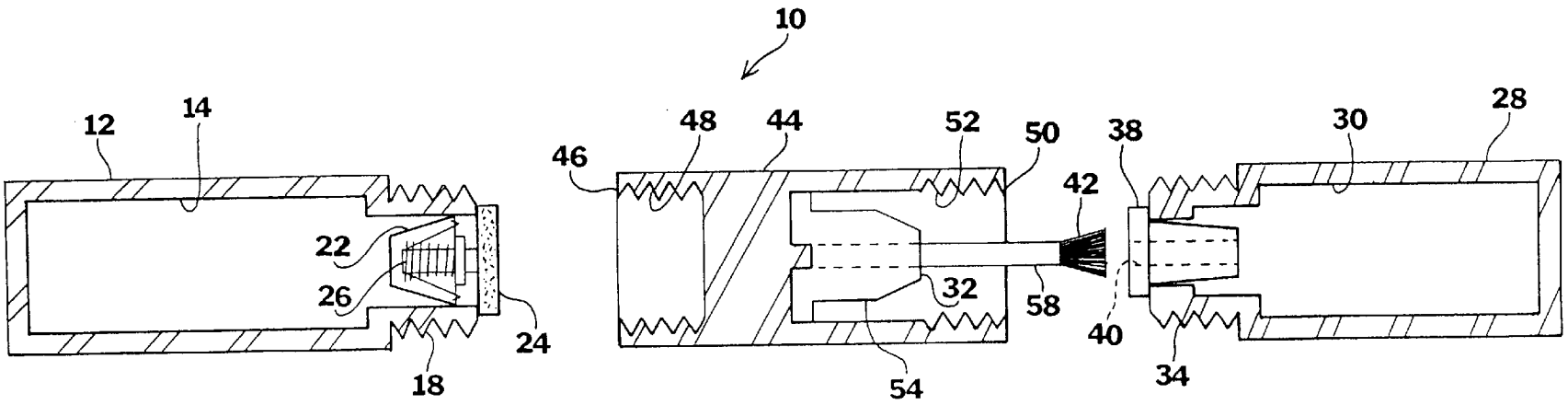
FIG. 2 is an exploded view of the instant invention, illustrating from left to right, a first container, an emery board, a sponge applicator assembly, a lid structure, a head member of the brush assembly, a shaft with bristles, a check valve, and a second container.

The nail polish application and removal device 10 further comprises a second container 28 having an internal reservoir 30 for storing nail polish. The second container 28 is preferably constructed of a transparent material such a clear plastic or glass so as to enable a user to determine the color and availability of the nail polish without having the remove a brush assembly 32 from the second container 28. The second container 28 also includes a threaded neck 34 and an opening 36 for receiving a check valve 38. FIG. 2 illustrates the check valve 38 which is made of a semi-rigid plastic and snap fits into the opening 36 of the second container 28. The check valve 38 includes a central bore 40 for the passage of the brush assembly 32, yet to be described. The central bore 40 of the check valve 38 serves to straighten bristles 42 of the brush assembly 32 as the bristles 42 are withdrawn from the second container 28.

FIG. 2 and 3 illustrate the nail polish application and removal device 10 including a lid structure 44 which serves to close the openings 20 and 36 of the first 12 and second 28 containers. The lid structure 44 includes a first end 46 having an internally threaded bore 48 for rotatably receiving the externally threaded neck 18 of the first container 12 and a second end 50 having an internally threaded bore 52 for rotatably receiving the externally threaded neck 34 of the second container 28. The brush assembly 32 includes a head member 54 which snap fits into the bore 52 of the second end 50 of the lid structure 44. The head member 54 includes a central bore 56 and a conical exterior portion which coincides with the interior configuration of the check valve 38 so that when the lid structure 44 is screwed onto the threaded neck 34 of the second container 28, the conical portion firmly engages with the interior of the check valve 38, thereby properly sealing the second container 28. The brush assembly 32 further includes a shaft 58, bristles 42 attached to one end 60 of the shaft 58 for facilitating application of nail polish, and the other end 62 securely mounted within the central bore 56 of the head member 54.

Many specific details contained in the above description merely illustrate some preferred embodiments and should not be construed as a limitation on the scope of the invention. Many other variations are possible.

What is claimed is:

1. A device for applying and removing nail polish, comprising:

a) a first container having an internal reservoir for storing polish remover solvent, said first container including a threaded neck and an opening;

b) a second container having an internal reservoir for storing nail polish, said second container including a threaded neck and an opening;

c) a lid structure for closing the openings of the first and second containers, said lid structure including a first end having an internally threaded bore for rotatably receiving the threaded neck of the first container and a second end having an internally threaded bore for rotatably receiving the threaded neck of the second container; and d) a brush assembly including a shaft and bristles attached to said shaft for facilitating application of the nail polish, wherein the brush assembly further comprises a head member sized and shaped so as to allow the head member to fit into the bore of the second end of the lid structure, said head member including a central bore for receiving the shaft opposite the bristles; and e) a sponge applicator detachably mounted within the opening of the first container for facilitating application of the polish remover solvent, said sponge applicator including a sponge pad dispensing of the polish remover solvent from the internal reservoir of the first container onto the sponge pad.

2. The device of claim 1, further comprising a check valve detachably mounted within the opening of the second container for straighten the bristles of the brush assembly as the bristles are withdrawn from the second container, said check valve includes a central bore for the passage of the bristles and shaft of the brush assembly.

3. The device of claim 2, further comprising an exterior surface and a replaceable emery board removably attached to said exterior surface for filing and shaping nails, said emery board includes a coating of adhesive for securing the emery board to the exterior surface.

4. The device of claim 3, wherein the first container is constructed of a flexible and resilient plastic material.

* * * * *